US005339086A

United States Patent [19]

DeLuca et al.

[11] Patent Number: 5,339,086

[45] Date of Patent: Aug. 16, 1994

[54] PHASED ARRAY ANTENNA WITH DISTRIBUTED BEAM STEERING

[75] Inventors: Amedeo DeLuca, Philadelphia, Pa.; James E. Gentry, Sr., Mount Laurel, N.J.; David L. Thomas, Millville, N.J.; Norman R. Landry; Ashok K. Agrawal, both of Mount Laurel, N.J.

[73] Assignee: General Electric Co., Moorestown, N.J.

[21] Appl. No.: 20,698

[22] Filed: Feb. 22, 1993

[51] Int. Cl.[5] ..... H01Q 3/22

[52] U.S. Cl. ..... 342/371; 342/377

[58] Field of Search ..... 342/371, 372, 377

[56] References Cited

U.S. PATENT DOCUMENTS

| | | | |
|---|---|---|---|
| 4,445,119 | 4/1984 | Works | 342/377 |
| 4,980,691 | 12/1990 | Rigg et al. | 342/372 |
| 5,103,232 | 4/1992 | Chang et al. | 342/372 |

*Primary Examiner*—Gregory C. Issing
*Attorney, Agent, or Firm*—W. H. Meise; C. A. Nieves; S. A. Young

[57] ABSTRACT

An antenna array (10) includes a plurality of antenna elements (12), each of which is associated with a transmit-receive TR module (14). The antenna elements and their associated TR modules are grouped into sets, which in the illustrated embodiment are sets of four. Each set of four TR module/antenna elements is associated with one phase and gain controller (18$_X$), which is part of a distributed phase and gain controller. The beam direction is commanded by a central radar control computer (RCC) (22), which transmits beam direction and other information to all the separate phase/gain controllers. Each separate phase/gain controller accesses local memory to obtain data relating to the location within the array of those antenna elements which it controls. Each phase/gain controller then calculates the necessary phase shift for each antenna element it controls, taking into account the phase and gain errors associated with the TR module associated therewith. The calculation is performed separately for the transmit and receive modes. While the described controller calculates for both transmit and receive modules, in a transmit-only or receive-only system, only transmit or receive-mode values, respectively, need be calculated.

8 Claims, 6 Drawing Sheets

PHASED ARRAY ANTENNA WITH DISTRIBUTED BEAM STEERING

BACKGROUND OF THE INVENTION

This invention relates to phased array antennas, and more particularly to distributed arrangements for control of the beam direction.

Directional antennas are widely used in a variety of detection and communication applications. High gain can be achieved in an antenna system by the use of a relatively simple feed antenna directed toward a shaped reflector. Those skilled in the antenna art know that the effective aperture of the reflector and its shape determine the beam shape and gain. Such antennas are passive, in that they contain no unidirectional elements, and therefore their performance in a transmission and reception modes are identical, even though their descriptions may be couched in terms of either transmission or reception.

When antenna gain must be very high, the aperture subtended by the reflector must be large, and as known such reflectors have a three-dimensional curvature. The large size and curved nature of the reflectors makes them heavy and prone to damage due to wind loading. Also, the inertia of the mass of the reflector demands large motors and substantial power when rapid slewing of the antenna is required to redirect the beam.

Phased-array antennas solve some of the problems associated with reflector-type antennas. For a given gain, the aperture of the phased array antenna is required to be about the same as the aperture of the reflector antenna. However, the phased-array antenna can be made as an essentially flat structure, which lends itself to applications on moving vehicles, and makes it less susceptible to lateral wind movements in ground-based applications. The phased-array antenna includes a plurality of elemental antennas arranged in an array, and fed with a particular phase and amplitude distribution as required to achieve the desired performance. The beam direction of a phased-array antenna may be selected by selection of phase shifts, which can be performed electronically. Thus, the antenna structure can be fixed.

As described above, the phased-array antenna may be reciprocal. When high transmitted power is desired, each antenna element of the phased array may be associated with an independent amplifier, to thereby form an "active" array. In such an active array, the total transmitted power represents the cumulated power of the amplifiers. In a receive mode, the losses in the phased-array feed system, which would otherwise result in degraded noise performance of the antenna, may be overcome by the use of a low-noise amplifier associated with each elemental antenna, for preamplifying the signal received at each antenna before it is attenuated by the feed system losses. The transmit and receive amplifiers are unidirectional, so that the parameters of the phased array antenna as a whole may be different in the transmission and reception modes. The transmit and receive amplifiers, and the controllable phase shifters, may be located in a transmit-receive (TR) module associated with each elemental antenna. U.S. Pat. No. 5,103,233, issued Apr. 7, 1992, in the name of Gallagher et al, describes a radar system which takes advantage of some of the properties of active phased-array antennas to achieve high-speed volume surveillance in an air traffic control radar context.

As described in the above mentioned Gallagher et al patent, the phase shifters and attenuators of each transmit-receive module associated with each elemental antenna may be controlled from a central location. As also mentioned therein, the central location tends to require a substantial data flow between the central control unit and each transmit-receive module. A distributed scheme is also described in the Gallagher et al patent, in which each elemental antenna is associated with a controller which performs many of the computations which would otherwise have to be performed at the central computer. This arrangement allows the central computer to transmit simpler commands to the various phase shifters than in the centralized system, thereby reducing the amount of data flow through the system by transferring substantial amount of the computations to the individual TR modules.

An improved phased array antenna system is desired.

SUMMARY OF THE INVENTION

A phased array antenna system includes a plurality of antenna elements arrayed in an antenna array, and interconnected in groups. In one embodiment of the invention, the antenna elements are interconnected in groups of four. A phase shifting arrangement is individually coupled to each of the antenna elements for phase shifting the signals applied to the elements. The phase shifting elements are also arranged in groups corresponding to the grouping of the antenna elements. An antenna beam controller generates beam angle signals which are representative of the directional in which the antenna beam is to be formed by the array. A multipartite phase control arrangement is coupled to the phase shifting arrangements and to the beam controller. The multipartite phase control arrangement is made up of a plurality of portions or parts, with one part of the phase control arrangement being associated with each of the groups of phase shifting arrangements. Each of the parts of the phase control arrangement is simultaneously coupled to all of the phase shifting element of the associated group of phase shifting elements. Each part of the multipartite phase control arrangement includes a first or location memory programmed with information relating to the locations of the phase shifting arrangements in the array. Each part of the multipartite phase control arrangement also includes a second memory programmed with processing instructions relating to conversion of the beam angle signals into components associated with the antenna coordinate axes. Each part of the multipartite phase controller also includes an intermediate command generator coupled to the first and second memories and to the antenna beam controller for processing the beam angle signals by means of the processing instructions from the second memory and the location information from the first memory for producing unformatted phase shift command signals representing the phase shifts which each of the associated phase shifting arrangements must provide to cause the antenna beam to be formed in the desired direction. A third memory is pre-programmed with format information relating to the format of the phase control command signals required by the individual phase shifting arrangements, and a formatting arrangement is coupled to the third memory and to the intermediate command generator for formatting the unformatted phase shifted control signals for forming the formatted phase control signals. One or more of the first, second and third memories may be command-reprogrammable. The use of a single part of the phase control arrangement for controlling two or more phase shifters reduces cost by eliminating central control with its attendant high data flow, while minimizing the number of expensive distributed local controllers.

DESCRIPTION OF THE INVENTION

Figure 1:
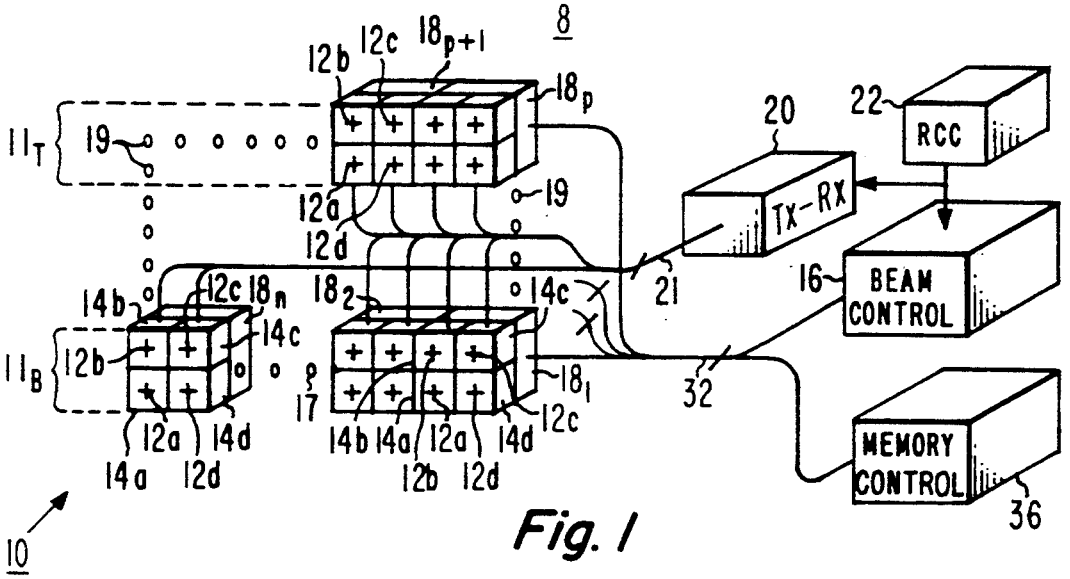
FIG. 1 is a simplified conceptual block diagram of a phased array antenna system in accordance with the invention.

In FIG. 1, a phased array antenna system designated generally as 8 includes an array, designated generally as 10, of elemental antennas, each of which is illustrated as a cross (+) designated 12. Each antenna 12 is associated with its own transmit-receive (TR) module, illustrated as a box 14. More specifically, each antenna 12 is mounted on an end face of its associated TR module 14. As illustrated in FIG. 1, elemental antennas 12 and their associated TR modules 14 are grouped in sets of four, and each set of four is associated with its own portion or part $\mathbf{18}_X$ of a multipartite distributed phase and gain controller (phase controller), which as a whole is designated 18, where x is an individual group or set identifier index. Thus, a portion $\mathbf{18}_1$ of phase controller 18, located at bottom right of array 10, is associated with four TR modules 14, designated 14*a*, 14*b*, 14*c* and 14*d* in FIG. 1, and with four elemental antennas, which are designated 12*a*, 12*b*, 12*c* and 12*d*. A plurality of additional controllers $\mathbf{18}_2 \ldots \mathbf{18}_n$ are arrayed in a bottom row $\mathbf{11}_B$ of array 10, as represented by ellipses 17. Each controller $\mathbf{18}_1, \mathbf{18}_2 \ldots \mathbf{18}_n$ is associated with its four TR modules 14 and its four elemental antennas 12. For example, in bottom row $\mathbf{11}_B$ of FIG. 1, left end distributed controller $\mathbf{18}_n$ is associated with elemental antennas 12*a*, 12*b*, 12*c* and 12*d* and with TR modules 14*a*, 14*b*, 14*c* and 14*d*. A plurality of similar horizontal rows 11 (not illustrated) of controllers 18 are stacked, one atop the other, as suggested by ellipses 19. Two distributed controllers $\mathbf{18}_p$, $\mathbf{18}_{p+1}$ of the topmost or upper row $\mathbf{11}_T$ are also illustrated, each associated with its elemental antennas 12 and TR modules 14.

As also illustrated in FIG. 1, a transmit-receive (Tx-Rx) signal source illustrated as a block 20 is coupled by a set 21 of transmission paths to each individual TR module, whereby transmit and receive signals may be coupled to the associated radiating element 12 of array 10. Transmit-receive block 20 produces radio-frequency or microwave (RF) signals which are ultimately applied to each of the radiating elements 12 of array 10. The radio-frequency signals produced by transmitter-receiver 20 include time reference information such as amplitude, phase or frequency shifts, the times of occurrence of which are controlled by a radar control computer (RCC) 22. Radar control computer 22 also establishes, at each moment, the desired direction in which the radio-frequency energy is to be directed, and couples this information to a beam control system illustrated as a block 16. Beam control system 16 processes the direction information and applies it over a data path 32 to each part $\mathbf{18}_1$, $\mathbf{18}_2 \ldots$ of the multipartite phase controller 18. A global memory and control block 36 is also coupled to antenna array system 8, and is loaded with data representing correction values, described below, for each TR module, together with its serial number.

Figure 2A:
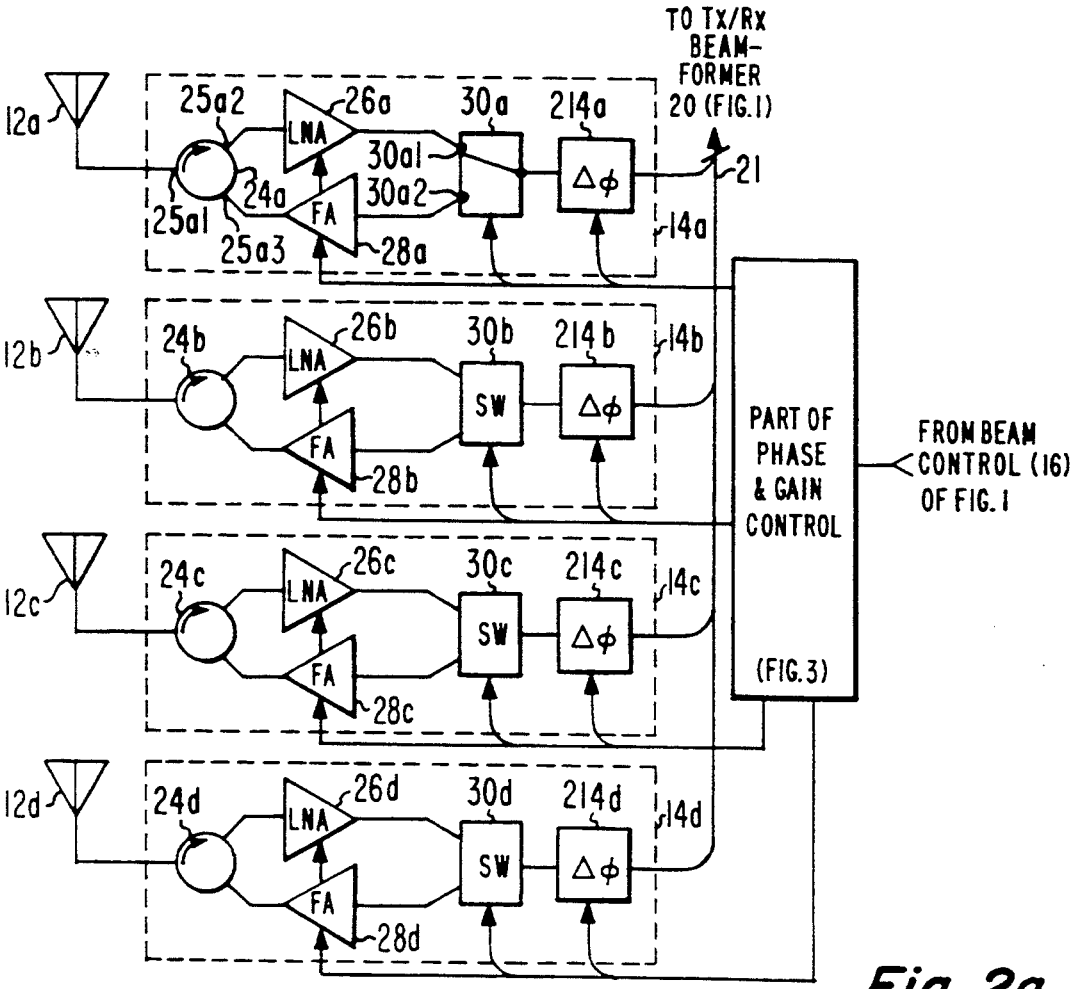
FIG. 2*a* is a simplified block diagram of one subset of distributed control of the arrangement of FIG. 1 and its associated transmit-receive (TR) modules.

In FIG. 2*a*, elements corresponding to those of FIG. 1 are designated by like reference numerals. FIG. 2*a* illustrates one part, designated $\mathbf{18}_X$, of multipartite phase control 18, together with the four antenna elements 12*a*, 12*b*, 12*c* and 12*d* with which it is associated, and also illustrates, in simplified block and schematic form, the transmit-receive module 14*a*, 14*b*, 14*c* and 14*d* associated with each elemental antenna 12*a*, 12*b*, 12*c* and 12*d*. It should be understood that the representation of four elemental arrays and four transmit-receive modules associated with each part $\mathbf{18}_X$ of the multipartite phase control 18 is for illustrative purposes only, and any number of elemental antennas 12 and transmit-receive modules 14 may be used in conjunction with each part of multipartite phase control $\mathbf{18}_X$, so long as the number exceeds unity and is less than the total number of elements in array 10. A cost advantage results, although the greatest cost reduction may occur when particular numbers, such as four, of elemental antennas are associated with each part of the phase control.

FIG. 2*a* represents a group of four elemental antennas 12 of FIG. 1 (i.e. 12*a*, 12*b*, 12*c* and 12*d*), and their four associated TR modules 14 (i.e. 14*a*, 14*b*, 14*c* and 14*d*), with a part $\mathbf{18}_X$ of the distributed phase control. In FIG. 2*a*, transmit-receive module 14*a* is representative of the other transmit-receive modules of FIGS. 1 and 2. In FIG. 2*a*, transmit-receive module 14*a* includes a circulator 24*a* including a first port 25*a*1 coupled to elemental antenna 12*a*, a second port 25*a*2 coupled to an input port of a controllable-gain low-noise amplifier (LNA) 26*a*, and a third port 25*a*3 coupled to the output port of a controllable-gain final amplifier (FA) 28*a*. As known, circulator 24*a* circulates signals received by way of elemental array 12*a* from port 25*a*1 to port 25*a*2 for application to the input port of LNA 26*a*, and circulates signals from the output port of FA 28*a* from port 25*a*3 to port 25*a*1 and antenna 12*a* for transmission. Also within TR module 14*a*, the output port of LNA 26*a* is coupled to a terminal 30*a*1 of a transmit-receive switch 30*a*, and the input port of FA 28*a* is coupled to a second terminal 30*a*2 of switch 30*a*. While a mechanical switch symbol is used to represent switch 30*a*, those skilled in the art know that it represents a solid-state switch. In the illustrated position of switch 30*a*, amplified signals from the output port of LNA 26*a* are applied to a phase shifter ($\Delta\phi$) for phase shift thereof. The low-noise-amplified, switched and phase-shifted signals are applied by way of a transmission path 298, which is part of path set 21, to a transmit-receive beamformer (not separately illustrated) associated with Tx-Rx block 20 of FIG. 1.

As illustrated in FIG. 2*a*, low noise amplifier 26*a*, final amplifier 28*a*, and switch 30*a* receive control signals from beam control block 16 of FIG. 1 by way of data path 32, part $\mathbf{18}_X$ of the phase control, and a data path 296. Phase and gain controller portion $\mathbf{18}_X$ receives duplicate sets of command signals over duplicate data paths (not separately illustrated in FIG. 2) within data path 32, arbitrates the information, and determines from the arbitrated information the direction cosines or phase taper (frequency scaled direction cosines) required to produce the desired beam, as described below. The direction cosines (for a narrow-band system) or phase taper (for a broadband system) are then used the calculate the required phases and gains for each amplifier and phase shifter which the portion 18N controls. In general, the desired phase shift $\phi$ for a phase shifter is derived from:

$$\phi = xu + yv + \phi_1 + \phi_G \quad (1)$$

where u and v are the direction cosines; x and y are Cartesian coordinates of the TR module in the array; $\Phi_1$ is a fixed phase offset; and $\Phi_G$ is the phase resulting from the gain selected for LNA 26 (in reception mode) or FA 28 (transmission).

Also, the required gain G will be $$G = G_i + G_T + G_\phi \quad (2)$$

where $G_i$ is the insertion gain or loss; $G_T$ is a fixed [gain offset]; and $G(\Phi)$ is the gain change resulting from the phase selection in phase shifter 214.

Figure 2B:
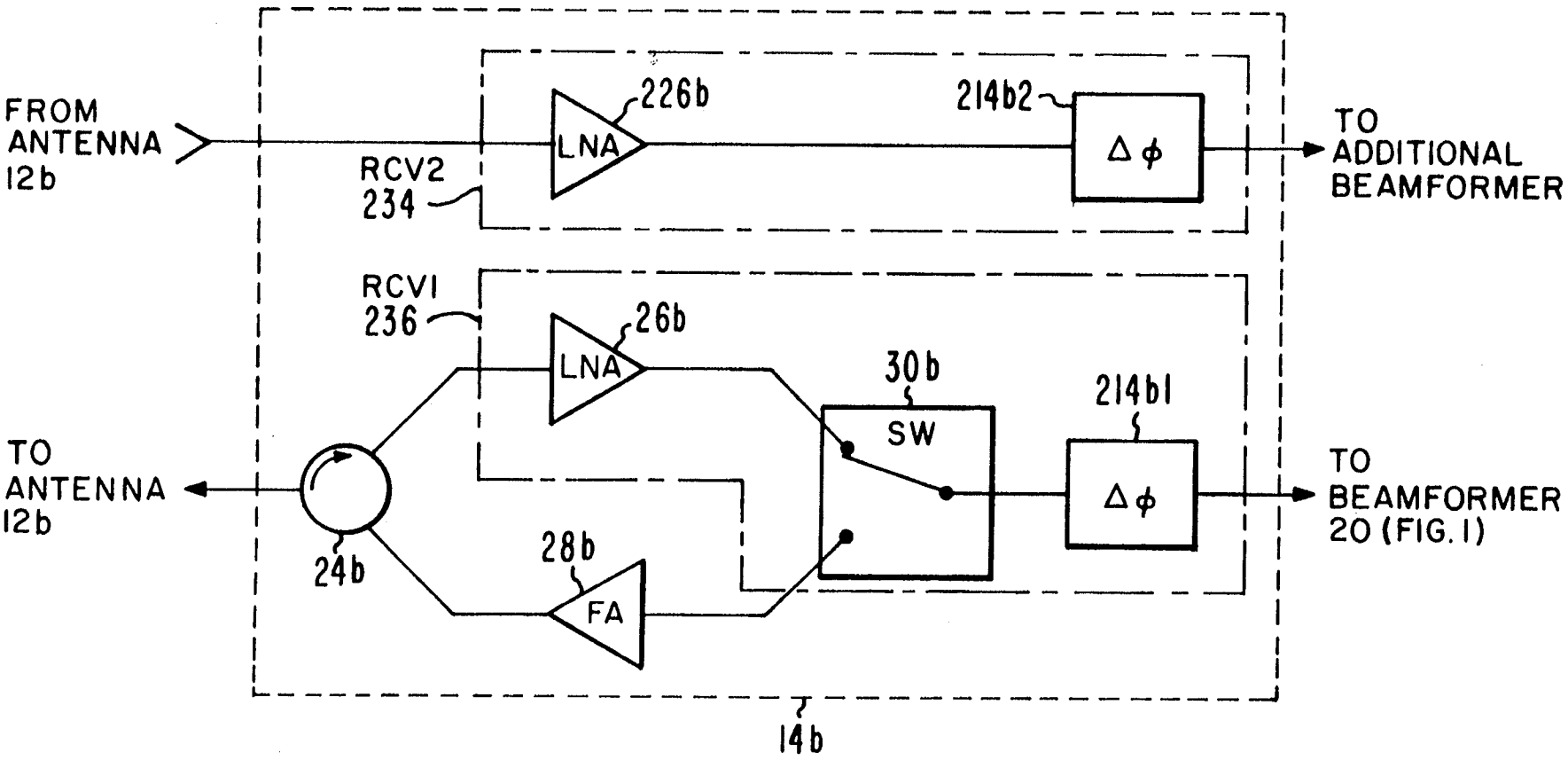
FIG. 2*b* is a simplified block diagram of an alternative TR module of FIG. 2*a*, modified for monopulse reception.

FIG. 2*b* is a simplified block diagram of one of the TR modules 14 of FIG. 2*a*, which is adapted for use with a monopulse receiver. For definiteness, FIG. 2*b* represents TR module 14*b* of FIG. 2*a*. Elements of FIG. 2*b* corresponding to those of FIG. 2*a* are designated by like reference numerals. Phase shifter 214*b* of FIG. 2*a* has been redesignated as 214*b*1 to distinguish it from additional elements. Those skilled in the art know that a monopulse receiver requires at least two receive channels, and that the signals in those two channels process the signals in different manners. The signals from the two channels may, but need not, originate from different antennas. In FIG. 2*b*, TR module 14*b* includes as additional elements a further low-noise amplifier (LNA) 226*b*, the input of which is arranged to be coupled to a portion of antenna 12*b* of FIG. 2*a*, and the output of which is coupled to an additional phase shifter ($\Delta\phi$) 214*b*2. The combination of LNA 226*b* and $\Delta\phi$ 214*b*2 is designated as receiver 2 (RCV2) 234. Correspondingly, the combination of LNA 266 and $\Delta\phi$ 214*b*1, which are interconnected by switch 30*b*, is designated receiver 1 (RCV1) 236. It is noted that, while RCV2 234 has its own dedicated phase shifter 214*b*2, RCV1 236 shares its phase shifter 214*b*1 with the transmitter function of the TR module, under the control of switch 30*b*.

Figure 3:
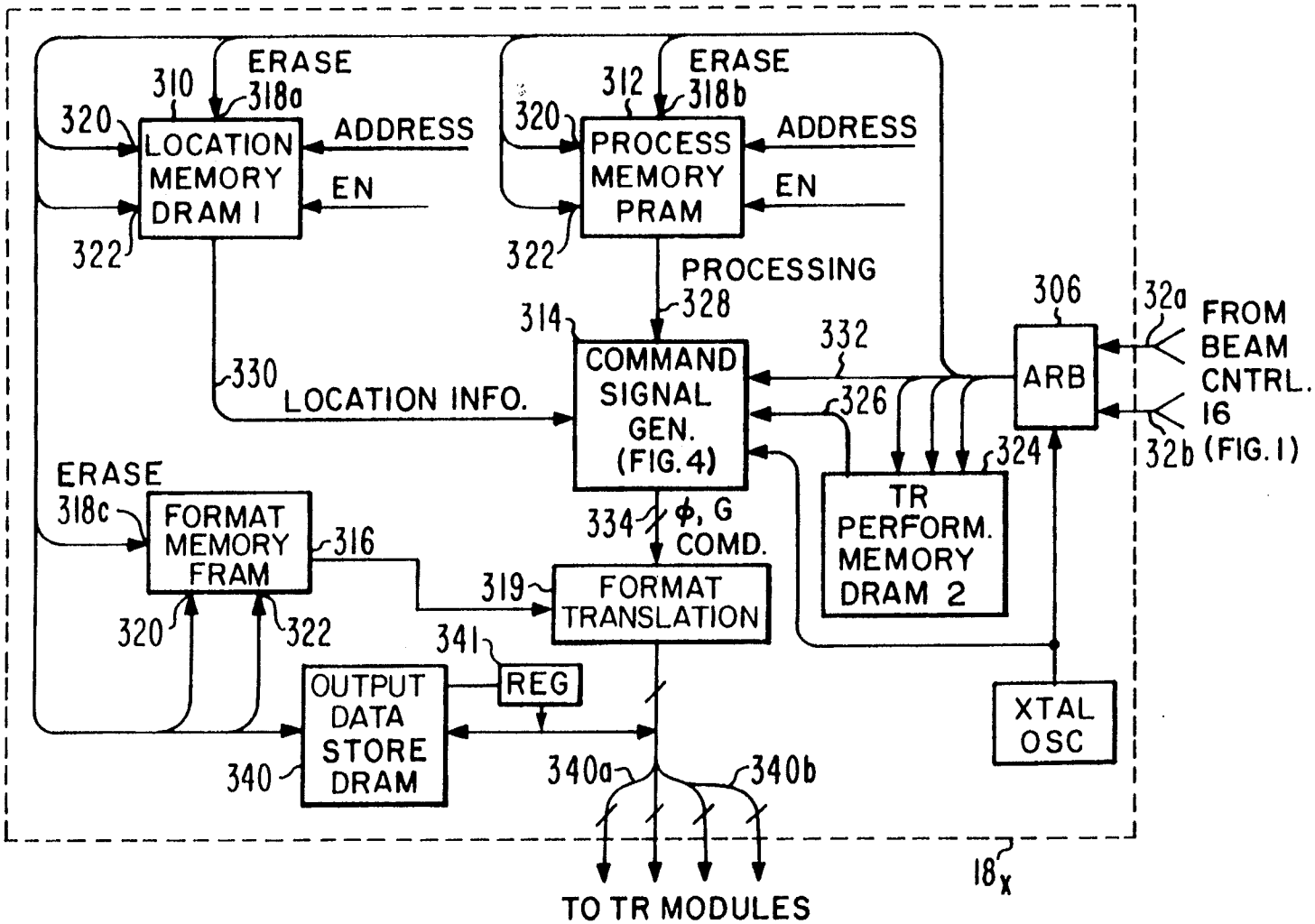
FIG. 3 is a simplified block diagram of the phase controller associated with the subset of FIG. 2*a;*

FIG. 3 is a simplified block diagram of portion $18_X$ of the phase control of FIG. 2. In FIG. 3, duplicate commands which are applied to arbitrator (ARB) 306 over redundant data paths 32*a* and 32*b* are arbitrated. If the command signals arrive over data paths 32*a* and 32*b* continuously, arbitrator 306 selects a particular one, and otherwise selects the first one to arrive, and couples the selected signal onto a bus 332. As illustrated in FIG. 3, phase control portion $18_X$ includes a location memory 310, which is loaded with data or information identifying the coordinates or location within the array of each elemental antenna 12 of the set of four elemental antennas which is associated with the particular phase controller portion $18_X$.

As described below, location memory 310 may be loaded during an initial or turn-on sequence for automatically making the location determination. Memory 310 is physically part of a RAM (not illustrated as a whole) which is external to (not included within) an application specific integrated circuit (ASIC) which includes most of the remaining element of FIG. 3. Since most of the structure of FIG. 3 is contained within an ASIC, the term "ASIC" may be used instead of "distributed controller portion $18_X$". The RAM, of which location memory 310 is a part, is referred to as DRAM herein, because it is loaded at various pages with Data such as location, transmit-mode gain and phase-shift corrections, receive-mode gain and phase-shift corrections, and the like. Location memory 310 is that portion (DRAM 1) of DRAM which represents pages loaded with location data. Memory 310 is interconnected by a data path 330 with a command signal generator illustrated as a block 314. The DRAM of which location memory 310 is a part may be erased or overwritten by commands applied over a data path portion 318*a*, and reloaded with different data for changing the location data in response to repairs or equipment swaps, and for changing other data described below. Command signal generator 314 is a processor which performs the aforementioned phase shift calculations, and which controls its set of four TR modules under the influence of information stored in associated memories, and of external commands applied over data path 332, arbitrator 306 and data path 32 from beam control block 16 of FIG. 1.

A process memory (PRAM), designated 312, which may be internal to the ASIC, is coupled with command signal generator 314 of FIG. 3 by way of a data path 328. Memory 312 is preloaded with processing or operating instructions for command signal processor 314. Process memory 314 may be erased or overwritten by commands applied over a data path portion 318*b* of data path 332, and reloaded with different commands originating at beam control 16 of FIG. 1, for changing the mode of operation of command signal processor 314. A format memory (FRAM), designated 316, which may be internal to the ASIC, is loaded with information relating to the format which the phase and gain command signals must have to interact properly with the TR modules to which they are applied. This information, together with command signals from processor 314, are applied to a format translation arrangement illustrated as a block 319. Block 319 translates the phase and amplitude commands into a format recognized by phase shifters 214 and controllable amplifiers 26, 28, respectively, of FIG. 2. Format memory 316 can be erased or overwritten by commands applied over a portion 318*c* of data path 332, and reloaded with different format information. This can be advantageous in the case where the same basic array antenna is used with more than one different kind of TR module, having different command formats. A TR performance memory 324 (DRAM2), which is part of DRAM, is preloaded with information relating to the particulars of the performance of the four associated TR modules, as for example the gains of the amplifiers in response to various commands, the initial gains and phase shifts, and like information. TR performance memory 324 is coupled by way of a data path 326 with command signal processor 314. As in the case of the other memories, memory 324 can be erased and reloaded with new data, representing the performance of new replacement TR modules, or with the performance as measured from time to time, reflecting the results of aging, corrosion, temperature, and other variables. The calculations for each of the four TR modules and/or phase shifters may be performed in parallel or sequentially, but if performed sequentially, an output buffer memory (ORAM), illustrated as 340, must be provided at least in association with format translation block 319 of FIG. 3 in order to store the values for each of the four phase shifters and/or TR modules of the associated set. The resulting translated, stored commands are applied over different data buses 340*a*, 340*b* . . . to the various TR modules/phase shifters of the set.

According to an aspect of the invention, ORAM 340 of FIG. 3 has sufficient memory capacity to store up to four separate sets of phase and gain data, for controlling the beam direction for both transmit and receive modes of operation for four different beam directions. This allows extremely rapid switching among beam directions, without the need for recalculation. For this purpose, ORAM 340 is partitioned into eight pages, four of which store transmit-mode information, and four of which store receive-mode information. An output register illustrated as 341 is associated with each ORAM 340, and the information to be used for TR module control is accessed from ORAM 340 and loaded into the output register 341. Upon a common command to all the portions $18_X$ of the distributed controller, the contents of the various output registers are simultaneously loaded into the associated TR modules. This allows all TR modules to control the beam direction and gain simultaneously.

Each recurrent beam control message produced by radar control computer 22 may include up to four parts, each with a fixed number of bits, such as 24. Execution of each part occurs immediately upon verification of its checksum. The first part, 16 bits long with an 8-bit checksum, identifies the page of ORAM 340 information which is to be loaded into its output register 341. A second "message" (M) portion includes a 72-bit data portion which carries the u and v and the function to be performed, such as beam steering, memory refresh, memory read, and SET ASIC address, as described below. A third "address" (A) portion or field, following the M field, identifies the address of the ASIC or controller portion $18_X$ which is to be acted upon, and also includes the identity of the particular RAM (i.e. DRAM 310/324, PRAM 312, FRAM 316, or ORAM 340) associated with the ASIC which is to be refreshed or read. The A field also indicates when a broadcast message is transmitted, which is a message which is directed to all ASICs. the last "refresh" (R) portion or field of the message is data which is to be loaded into the specific identified RAM for refresh thereof.

The beam control signals or commands, which are applied from beam control computer block 16 of FIG. 1 to the various portions $18_X$ of the distributed beam controller, include information identifying the desired beam direction, as described above, and also include information relating to the operating frequency (which affects phase shift), and establishes the transmission or reception mode 64 by identifying for access those pages of DRAM which are dedicated to transmit or receive, respectively, gain and phase information.

Figure 4:
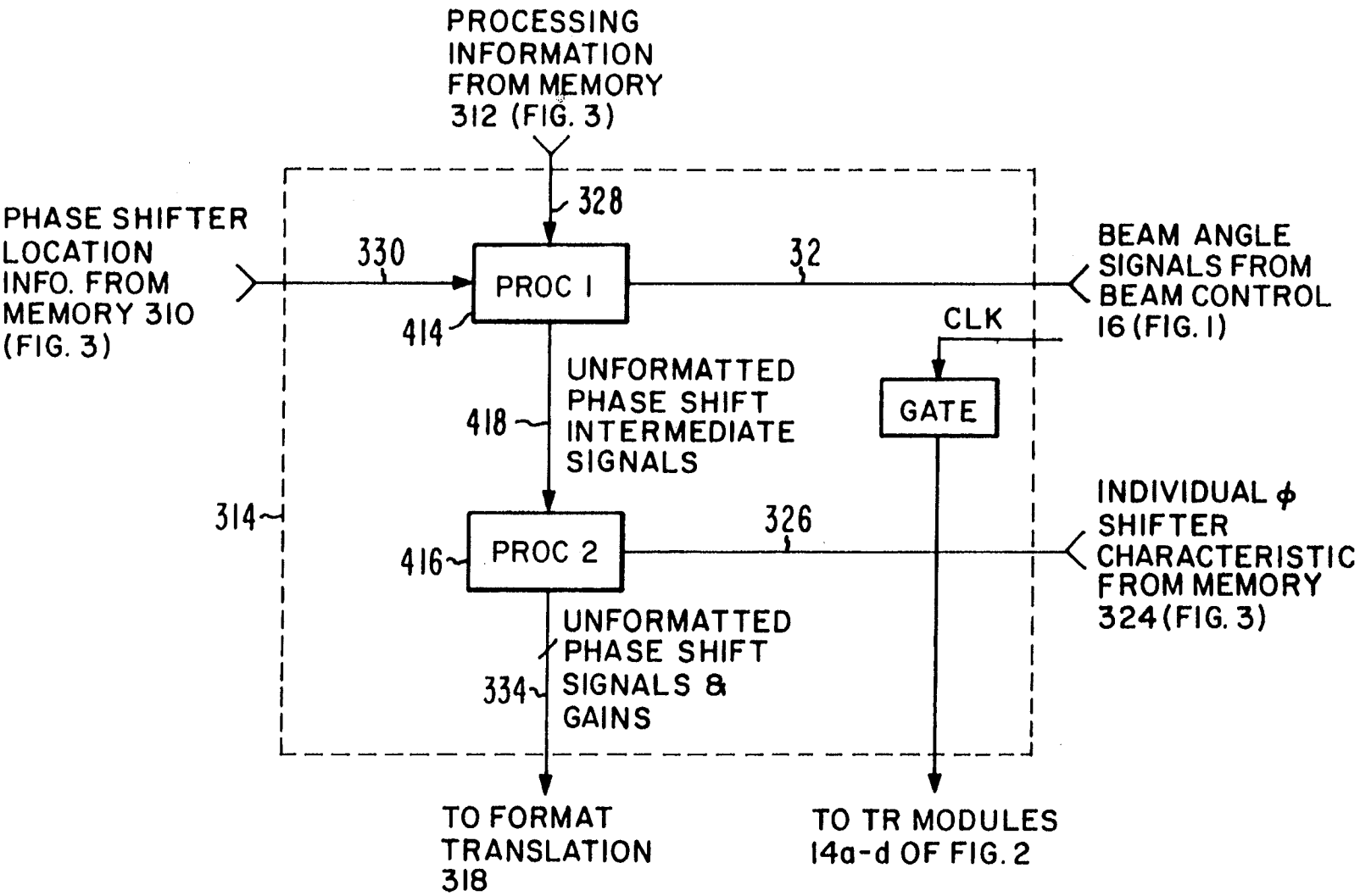
FIG. 4 is a simplified block diagram of the command signal generator of FIG. 3.

FIG. 4 is a simplified block diagram of command signal generator 314 of FIG. 3. As illustrated in FIG. 4, generator 314 includes a first processor (PROC 1) 414, which is coupled to receive location information from location memory 310 (DRAM1) of FIG. 3, processing information from process memory 312 (PRAM) of FIG. 3, and at least beam angle command signals from beam control 16 of FIG. 1 (by way of arbitrator 306 of FIG. 3). Processor 414 of FIG. 4 calculates the theoretical gain and/or phase shift which its associated TR modules must individually impart to the RF signal, and applies the resulting information over a data path 418 to a second processor (PROC 2) 416, which adjusts the theoretical information to take into account the actual performance of the TR module. For example, if the theoretical phase shift for a particular beam direction is 130°, but the TR module has an inherent phase shift of −20°, the two values are summed in processor 416 to produce a command for a phase change of 150°, whereby the −20° inherent phase shift is overcome. As described below, other corrections are also provided.

Figure 5A:
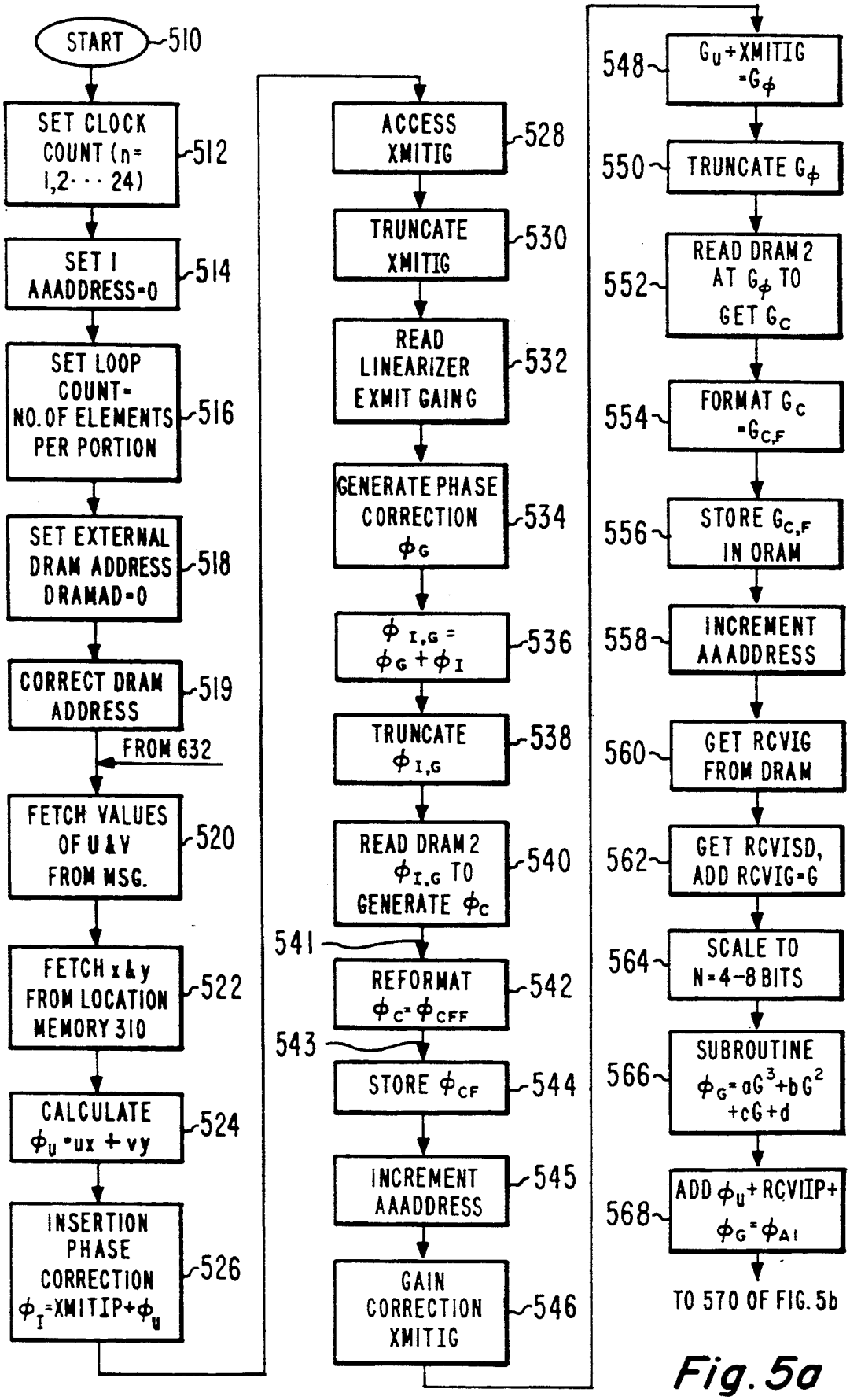
FIGS. 5*a* and 5*b* together are a flow chart representing the calculation of phase shifts and gains within one part of a multipartite phase control of FIG. 1.
Figure 5B:
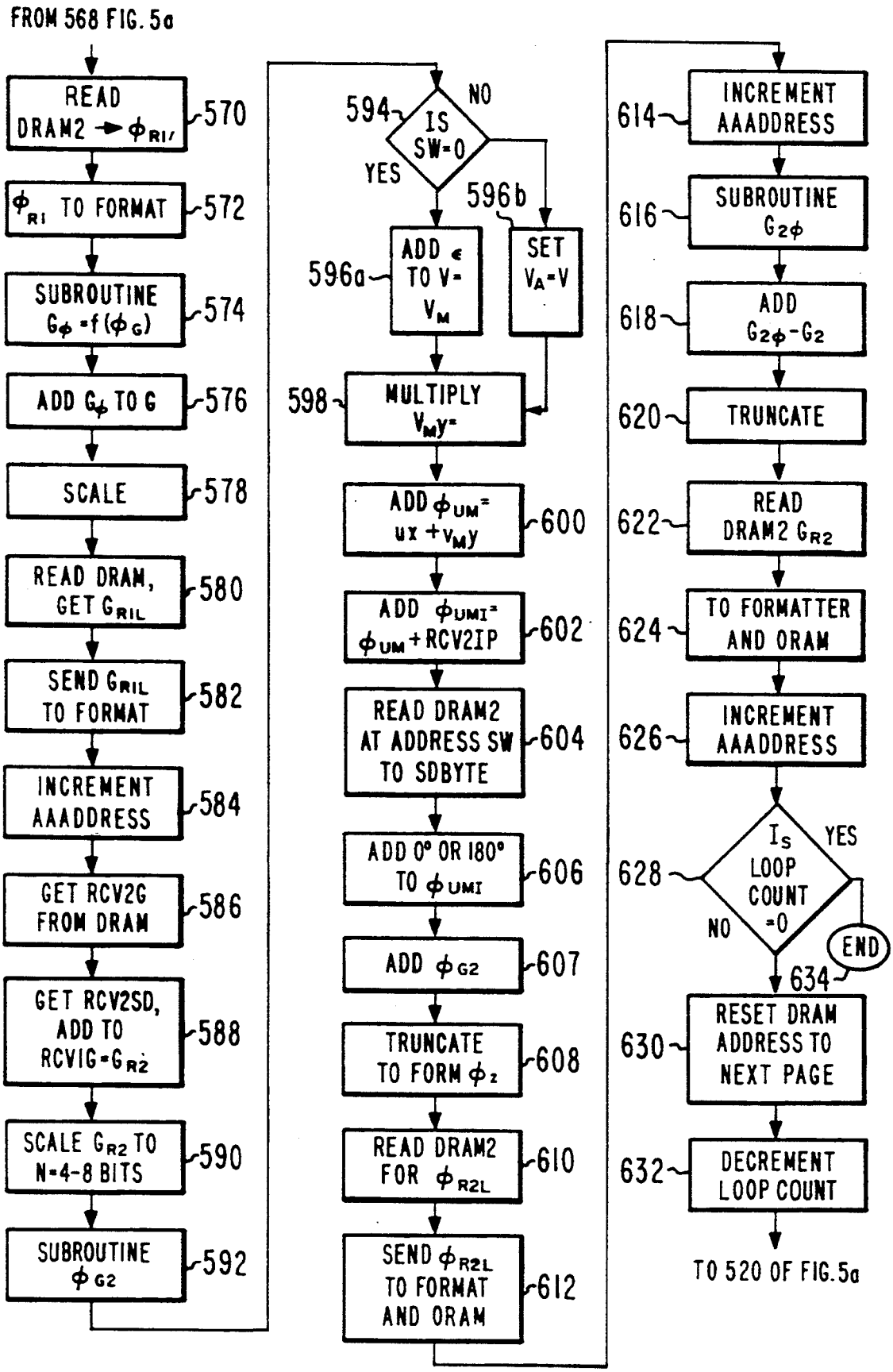

FIG. 5 is a flow chart representing the processing of command signal generator 314 and formatter 319 of FIG. 4 in response to beam angle and other control signals. Initially it should be stated that external data RAM DRAM is divided into a plurality of sections, one of which is associated with each TR module, and each section includes a plurality of pages, one of which is for transmission and one for reception-mode information. Within each page, the data relating to phase and gain corrections is located at sequential addresses in the same order in which it is accessed by the logic of FIGS. 5*a* and 5*b*. Thus, the DRAM is preloaded with correction data for compensating for the phase and gain deviations of the associated TR module, and also for compensating for system errors.

In FIG. 5, the processing starts at a start block 510, and proceeds to a block 512, which represents the setting of a clock count n to a value generally in the range of 1–24, representing the number of bits of data to be transferred to each TR module. From logic block 512, the logic flows to a block 514, representing the setting to zero of the current address (AAADDRESS) of output RAM 340 (ORAM) associated with format translator 319 of FIG. 3. The address is set to zero in order to prepare the output RAM to accept the results of the first calculation. The output RAM, when loaded by the format translator, makes the beam angle signals and gain signals simultaneously available to the TR modules. From block 514, the logic flows to a block 516, which represents setting a loop count index to a value 1, 2, 3 or 4, representing the number of TR modules associated with each portion of the phase controller. This determines the number of times the controller calculates the gain and beam angle (or phase) signals per control cycle, once for each TR module. With the loop count set to four (for the four TR modules per controller portion 18*n* of FIGS. 1, 2 and 3) in block 516, calculation can begin on the values of phase and gain which must be determined for the phase shifter 214*a* and gains of amplifiers 26*a* and 28*a* of TR module 14*a* associated with the first antenna element 12*a* of the set of four antenna elements of FIG. 2.

From block 516 of FIG. 5, the logic flows to a block 518, which represents the setting to zero of the address DRAMAD of the external data RAM (DRAM) illustrated as blocks 310 and 324, which are associated with controller 314 of FIG. 4, so that DRAMAD=0 for the first iteration. From block 518, the logic flows to a block 519, which represents modification of the DRAM address by the frequency index contained within the beam control message, in order to access the correct page or portion of DRAM for the phase and gain correction data. From block 519, the logic flows to a block 520, representing obtenence of values of phase tapers u and v from the beam control message applied to controller 314 from arbitrator 306 of FIG. 3. Once the phase tapers from the beam control message as verified, location coordinate information is read from external data RAM 310, 324, and the uncorrected phase value $\phi_u$ is calculated as the sum of products ux+vy in a block 524.

The next step in the logic flow is to correct the uncorrected phase $\phi_u$ for the transmit insertion phase XMITIP of the particular TR module, which differs from unit to unit. The XMITIP correction is performed in a block 526 of FIG. 5 by adding to the uncorrected phase value a correction phase extracted from DRAM2 324, to produce an insertion phase corrected phase $\phi_I$. From block 526, the logic flows to a block 528, which represents accessing of the transmit insertion gain XMITIG from DRAM2 324. In general, the number of bits may be greater than the number required to represent the available pages in DRAM2. Block 530 represents truncation or, if necessary, rounding of the XMITIG value to the number of bits which are appropriate to address memory DRAM 2. The truncated XMITIG value is used in block 532 as an address to access DRAM 2 of the external DRAM at a page which produces an insertion gain correction value G corrected for the amplitude nonlinearities of the particular attenuator or AGC amplifier in the particular TR module for which the calculation is made.

Once the gain is calculated, the effect on phase of phase shifts of the gain attenuator may be corrected. This is accomplished in a block 534 of FIG. 5*a*, which represents a subroutine, which solves a cubic equation to determine a phase correction $\phi_G$ $$\phi_G = aG^3 + bG^2cG + d \tag{3}$$

where a, b, c and d are predetermined constants determined empirically, and G has been determined in block 532. In block 536, the phase correction $\phi_G$ is added to the insertion phase corrected gain value $\phi_I$ from block 526, to produce a phase value $\phi_{I,G}$ which is still uncorrected for the phase linearity of the phase shifter of the particular TR module for which the calculations are being performed (as opposed to the insertion phase of the entire TR module). In block 538, the number of bits in $\phi_{I,G}$ is reduced, and in block 540, external data RAM DRAM 2 is addressed by $\phi_{I,G}$ to generated corrected phase value $\phi_C$.

The corrected phase value $\phi_C$ generated in block 540 of FIG. 5*a* may be in a format which the individual TR modules cannot accept. The value of $\phi_C$ is applied from block 540 to a block 542, which represents operation of formatter 319 of FIG. 3. Formatter 319 reformats $\phi_C$ using format information stored in format memory FRAM 316 of FIG. 3, to produce corrected, formatted phase value $\phi_{CF}$. Block 544 represents the storing of at AAADDRESS=0 in output RAM (ORAM) 340 of FIG. 3 of the value of $\phi_{CF}$ calculated during the above described logic flow for the first TR module of the four TR modules associated with the controller. block 545 represents incrementing of address value AAADDRESS by one, to prepare for storage of the calculated gain.

Once the corrected, formatted phase value $\phi_{CF}$ has been calculated for the first TR module and stored, the gain value must be calculated for that same first TR module. A gain correction XMITIG is generated in subroutine block 546 of FIG. 5*a*, which represents the change of gain caused by the current setting of the phase shifter of the TR module. In order to obtain maximum accuracy in the calculation, the untruncated value of corrected phase $\phi_{I,G}$ (generated in block 536) is processed in block 546 with a cubic equation $$XMITIG = e\phi_{I,G}^3 + f\phi_{I,G}^2 + g\phi_{I,G} + h \tag{4}$$

where e, f, g and h are empirically determined constants, previously stored in external RAM DRAM. The correction XMITIG to the gain which is attributable to the phase-shifter setting is added to the commanded gain $G_U$ from the command message in block 548, to produce gain corrected for phase shifter gain, or $G_{100}$. block 550 represents reduction of the number of bits of $G_{100}$ to match the address of DRAM 2, and block 552 represents access to that page of DRAM which includes corrected values $G_C$ of gain. The final, corrected transmit-mode gain $G_C$ for TR module 14*a* of FIG. 2 is sent to formatter 319 of FIG. 3 by the logic represented as block 554 of Row 5, to produce a formatted corrected gain $G_{C,F}$, and logic block 556 represents sending $G_{C,F}$ to output RAM ORAM 340, where it is stored at AAADDRESS=1, whereas $\phi_{C,F}$ previously calculated for TR module 14*a*, is stored at AAADDRESS=0.

The phase and gain for the first of the four TR modules having been calculated for the transmit mode, the receive mode phase and gain can now be determined. Block 558 of FIG. 5*a* represents incrementing the value of AAADDRESS to a RECEIVE page, to ready ORAM to accept the result of the calculation of corrected receive-mode phase for the first TR module.

Block 560 of FIG. 5*a* represents accessing of the insertion gain RCVIG (receiver 1 insertion gain), where receiver 1 refers to the "first" receiver 236 of the first TR module. The "second" receiver of the first TR module includes second LNA 226*b* and second phase shifter 214*b*2, used for monopulse purposes as described in conjunction with FIG. 2*b*. Block 562 represents accessing, under control of the M field of the beam control message, of one of four receiver gain tapers RCVISD from DRAM, and adding RCVISD to RCVIG, to form a nonlinearized gain value G to form a sum. Block 564 represents scaling of the sum to one of 4, 5, 6, 7 or 8 bits, so that the actual linearized value is used in the following subroutine. Block 566 is a subroutine, which calculates the value of the change in phase $\phi_3$ as a function of gain $$\phi_{G1} = aG^3 + bG^2 + cG + d \tag{5}$$

where a, b, c and d are the same coefficients previously used in equation (3), because the same phase shifter 214*a* is used both for transmission and reception, and G is the value calculated in block 562, scaled by block 564. block 568 represents summing of $\phi_U$ from block 524 with $\phi_G$ from block 566 and with the insertion phase RCV1IP of receiver 1 of TR module, accessed from DRAM, to produce a phase address $\phi_A$. block 570 represents accessing of DRAM2 at address $\phi_A$, to obtain a linearized receiver 1 phase value $\phi_{R1}$, which is sent to formatter 319 of FIG. 3 in block 572, for storage of formatted data in ORAM. With the phase for receiver 1 of first TR module 14*a* calculated, the logic proceeds with calculation of receiver 1 gain. Block 574 represents calculation of the gain of receiver 1 as a function of the phase, by using a subroutine $$G_\phi = e\phi_G^3 + f\phi_G^2 + g\phi_G + h \quad (6)$$

where e, f, g and h are empirically determined constants, and $\phi_G$ was calculated in block 566. Block 576 represents addition of $\phi_G$ from block 574 to G from block 562, to produce uncorrected receiver gain, which is truncated or scaled in block 578 to conform to the available addresses in DRAM. The particular addresses in DRAM allow access to the receiver 1 linearized gain $G_{R1L}$, as represented by block 580. From block 580, the logic flows to a block 582, representing sending the value of $G_{R1L}$ to the formatter, for formatting and storing of the formatted signal in ORAM.

The logic of FIGS. 5*a* and 5*b* can now begin calculations for receiver 2 (if present) of the first TR module. Block 584 represents the incrementing of ORAM (340 of FIG. 3) address AAADDRESS, to prepare it for receiving phase and gain information related to receiver 2 of the first TR module. Block 586 of FIG. 5*a* represents the accessing of receiver 2 insertion gain RCV2G from DRAM2 of FIG. 3, and block 588 represents the accessing of receiver 2 gain taper RCV2SD, and its addition to RCV2G to form $G_{R2}$. Block 590 represents scaling or truncating $G_{R2}$ to a number of bits in the range of four to eight.

Block 592 of FIG. 5*a* represents a subroutine for calculating the effect on receiver 2 phase as a function of receiver 2 gain $G_{R2}$ $$\phi_{G2} = iG_{R2}^3 + jG_{R2}^2 + kG_{R2} + m \quad (7)$$

where i, j, k and m are empirically determined constants, and $G_{R2}$ was determined in block 588.

Block 594 of FIG. 5*a* is a decision block, which examines a switch SW associated with the M field of the beam control messages. If the switch value is zero, block 596*a* is bypassed, and zero is added to V in block 596*b* to form $V_M$(i.e. V is redesignated as $V_M$), whereas if the switch value is 1, the logic proceeds to block 596*a*, in which the phase value of V from the message is added to an offset epsilon ($\epsilon$), read from DRAM, to slightly shift the beam position when receiver 2 is used. By either path, the logic arrives at a block 598, which represents multiplication of $V_M$ by y, and the logic then flows to a block 600, which represents adding ux, to form $\phi_{UM} = ux + v_M y$.

Block 602 of FIG. 5*b* represents the addition of receiver 2 insertion phase RCV2IP to $\phi_{UM}$ from block 600 to produce $\phi_{UMI}$. Block 604 represents reading of DRAM2 at an address controlled by the value of the same switch SW contained in the message, as was used in block 591. The 8-bit byte SDBYTE which is read from DRAM2 is examined at either bit zero or bit 1, as determined by the switch value. If the switch value is zero, the 0th bit of SDBYTE is examined, and the value of the bit may be logic 0 or logic 1. If the logic value is zero, zero degrees is added to $\phi_{UMI}$ (from block 602) in a block 606. If the value of bit 0 is 1, 180° is added in block 606. On the other hand, if the switch value is logic 1, the 1st bit of SDBYTE is examined. If bit 1 is zero, zero is added, and if bit 1 is logic 1, 180° is added in block 606. Block 607 adds $\phi_{G2}$ from block 592 to the modified $\phi_{UMI}$ of block 606, to form $\phi_Z$. The value of $\phi_Z$ is applied in block 610 as a pointer to DRAM2 to obtain the desired linearized receiver 2 phase $\phi_{R2L}$. Block 612 represents sending of the value of $\phi_{R2L}$ to formatter 319 of FIG. 3, and storing at the current value of AAADDRESS in ORAM. Block 614 represents incrementing of the AAADDRESS to prepare ORAM to receive the results of the next calculation.

To calculate the gain value $G_{2\phi}$ of receiver 2, the value of $\phi_Z$ from block 608 of FIG. 5*b* is used in a subroutine block 616 to calculate $$G_{2\phi} = n\phi z^3 + p\phi z^2 + q\phi z + r \quad (8)$$

where n, p, q and r are empirically determined constants.

Block 618 of FIG. 5*b* represents adding together $G_{2\phi}$, from block 616, and $G_2$, the commanded gain for receiver 2 from the message portion of the command from RCC 22 of FIG. 1. Block 620 represents truncation of the sum of $G_{2\phi}$ and $G_2$, and block 622 represents the reading of DRAM2 at the corresponding address, to get the receiver 2 gain $G_{R2}$. Block 624 represents the transfer of $G_{R2}$ to the formatter and ORAM, and block 626 represents incrementing of ORAM address AAADDRESS. At this point in the logic, the gain and phase, for transmit and receive operation, of one TR module have been calculated and stored in ORAM. Calculation must continue to determine gain and phase values for each of the other three modules.

A decision block 628 of FIG. 5*b* compares the loop count with zero. If only one TR module has been completed, the loop count will not have reached zero, so the logic leaves decision block 628 by the NO output and arrives at a block 630, representing resetting of the DRAM address to the next page, at which TR module 2 information is stored, Block 632 represents decrementing of the loop count, and the logic return to block 520 of FIG. 5*a*, to begin the calculation of values for TR module 2. The same procedure is followed to calculate for TR modules 3 and 4. when the logic arrives at decision block 628 after the fourth iteration, the loop count will be zero, and the logic will leave by the YES output, and arrive at an END block 634, which stops the calculations. The gain and phase values remain stored in ORAM 340 of FIG. 3, available for transfer to register 341 for transfer to the TR modules.

As mentioned, as many as four different beam direction/gain combinations may be simultaneously stored in ORAM, so that switching may readily be accomplished among various beams without recalculation. The additional information is calculated in the same basic fashion described in conjunction with FIGS. 5*a* and 5*b*, but the pages of ORAM in which the information is to be stored is specified in the message by a starting page address.

The radar control computer 22 of FIG. 1 is hardwired to each location in the array antenna 10 of FIG. 1, so each location into which a TR module can be inserted has its own address. Radar control computer 22 initiates identification of the TR modules by simultaneously addressing all columns of locations in the array with a SETADDRESS X or a SETADDRESS Y command, together with a starting address. Each column has a physical or electrical key associated with its top and bottom locations, which interlocks with the ASIC or controller inserted into that location, to allow that particular part of the controller to respond to SETADDRESS X or SETADDRESS Y. Thus, when a SETADDRESS command (either X or Y) is broadcast, only those controllers at the bottom or top, respectively, of a column respond. Suppose, for example, that the SETADDRESS X command is distributed. Only the bottom controller portion $18_X$ of each column responds by storing, in a location register in the controller, the initial address transmitted with the SETADDRESS X command. The bottom controller portion $18_X$ then sends the address to the next adjacent controller portion $18_{X+1}$. The next controller portion $18_{X+1}$ takes the address which it receives from controller 18, and either increments (for SETADDRESS X) or decrements (for SETADDRESS Y) in compliance with an increment/decrement command associated with the message. Thus, the lowermost controllers of all columns respond to the initial portion of the SETADDRESS X by storing the initial address, and transferring the address to the next controller. The next controller increments the address, stores it, and transfers the incremented address to the next controller of the column. Each controller of each column receives the address in sequence from the next lower controller, incrementing the address at each step. The size of the increment will depend upon the configuration of the four TR modules in the column (i.e. a square configuration as illustrated in FIG. 1, or possibly a four-in-line column, or some other configuration). When the topmost controller portion $18_X$ of each column receives the progressively increasing address from the penultimate controller, it increments the value and stores the incremented value. At this point, all controller portions $18_X$ of all the columns have stored in their registers an address, starting from the commanded initial address. All columns contain the same address at the same location counting from the bottom of the column. However, since information from only a particular column is required, the incorrect information (i.e. wrong starting address) in the additional columns is ignored. To determine the serial numbers of the TR modules in the column being tested, the RCC 22 addresses, in sequence, each individual controller at the locations of the column under test, using the just-assigned sequential location address, and reads the location information for each of the associated TR modules, together with their serial numbers. The column, the location in the column, and serial number information read and stored in global array memory 26. The above described procedure is repeated for each column in turn, using the initial address appropriate to each column, with the result that global array memory 26 is loaded with the array location of each TR module, together with its serial number. Thereafter, a particular array location may be accessed by the serial number of the corresponding TR module. When a particular TR module is addressed by its serial number, only that TR module responds, and data returned therefrom is uniquely identified.

Other embodiments of the invention will be apparent to those skilled in the art. For example, built-in test equipment (BITE) may be associated with each portion of the multipartite phase control for being interrogated and for returning information relating to the status of various portions of the system to a central controller. This status information may be returned in the form of serial signals routed by redundant paths, if desired. While variable gain low-noise amplifiers and final amplifiers have been described, fixed-gain amplifiers associated with variable attenuators may be used. Memories such as 310, 312, 316 and 324, which are illustrated as being separate in FIG. 3, may if desired be portions of a single memory structure. While the number of TR modules for each part of the controller has been described as four, the number may vary over the aperture of the array antenna; the number of TR modules per group may be four near the center of the array, reducing to two or even one near the edges of the array to achieve an amplitude taper. In many applications, no gain correction will be required, so that portion of the described processing and control attributable to gain correction may be dispensed with.

What is claimed is:

1. A phased array antenna system, comprising:

a plurality of arrayed antenna elements arranged in groups to form an antenna array;

a phase shifting arrangement coupled to each of said antenna elements, for phase-shifting signals transduced by the associated antenna element along two coordinate axes associated with said associated antenna, in response to parallel digital formatted phase control signals, whereby a plurality of said phase shifting arrangements are arranged in groups;

antenna beam control means for generating beam angle signals representative of the direction in which an antenna beam is to be formed by said antenna array;

multipartite phase control means coupled to said plurality of phase shifting arrangements and to said antenna control means, each part of said multipartite phase control means being simultaneously coupled with said phase shifting arrangements of one of said groups of phase shifting arrangements, each one of said parts of said multipartite phase control means including:

(a) first memory means, said first memory means being programmed with location information relating to the locations of the associated ones of said phase shifting arrangements in said array;

(b) second memory means, said second memory means being programmed with processing instructions relating to conversion of said beam angle signals into components associated with said antenna coordinate axes;

(c) intermediate command generating means coupled to said first and second memory means, and to said antenna control means, for processing said beam angle signals by means of said processing instructions and said location information for producing parallel digital unformatted phase shifter control signals representing the phase shifts which each of said phase shifting arrangements must provide to cause said antenna beam to be formed in said direction;

(d) third memory means, said third memory means being programmed with format information relating to the format of said formatted phase control signals required by said phase shifting arrangements of said one of said groups; and (e) formatting means coupled to said third memory means and to said intermediate command generating means, for formatting said unformatted phase shifter control signals for forming said parallel digital formatted phase control signals.

2. A system according to claim 1, wherein said first and third memory means are reloadable, and further comprising:

central memory loading means, said memory loading means including (a) means coupled to at least one of said first, second and third memory means of each of said multipartite phase control means, for controllably permitting information stored therein to be overwritten; and (b) information loading means coupled to said one of said first, second and third memory means of each of said multipartite phase control means, for updating the loading of said one of said memory means.

3. A system according to claim 2, wherein said one of said first, second and third memory means is said third memory means, whereby said phase shifting means may be freely interchanged with other types of phase shifting means having differing control signal formats, and said third memory means associated with said phase shifting means having a differing control signal format may be reprogrammed from said central memory loading means.

4. A system according to claim 1, further comprising:

fourth memory means associated with each of said parts of said multipartite phase control means and coupled to said central memory loading means, for being loaded by said central memory loading means with information relating to the individual characteristics of that one part of said phase shifting arrangement with which said part of said multipartite phase control is associated; and individual characteristic adaptation means associated with each of said multipartite phase control means, and coupled to said intermediate command generating means and to said fourth memory means for adapting said intermediate command signal in accordance with said information relating to the individual characteristics of said phase shifting arrangement.

5. A system according to claim 1, further comprising a plurality of gain-controllable means for controlling the amplitude of the signal passing therethrough in response to gain command signals, one of said gain-controllable means being coupled to each of said antenna elements for controlling the amplitude of the signal transduced thereby; and multipartite gain control means associated with said multipartite phase control means, each part of said multipartite gain control means being associated with a corresponding one of said parts of said multipartite phase control means, for controlling that group of said gain controllable means associated with said one of said groups of phase shifting arrangements in response to said phase control signals.

6. A system according to claim 5, wherein said gain controlling means may cause phase perturbations, and further comprising:

phase perturbation control means, for correcting for said phase perturbations in response to said gain command signals.

7. A system according to claim 1, wherein each said phase shifting arrangement may cause gain perturbations, and further comprising;

gain perturbation control means, for correcting for said gain perturbations in response to said phase shift control signals.

8. A phased array antenna system, comprising:

a plurality of arrayed antenna elements arranged in groups to form an antenna array;

a phase shifting arrangement coupled to each of said antenna elements, for phase-shifting signals transduced by the associated antenna element along two coordinate axes associated with said associated antenna, in response to formatted phase control signals, whereby a plurality of said phase shifting arrangements are arranged in groups;

antenna beam control means for generating beam angle signals representative of the direction in which an antenna beam is to be formed by said antenna array;

multipartite phase control means coupled to said plurality of phase shifting arrangements, each part of said multipartite phase control means being simultaneously coupled with said phase shifting arrangements of one of said groups of phase shifting arrangements, each one of said parts of said multipartite phase control means including:

(a) first memory means, said first memory means being programmed with location information relating to the locations of the associated ones of said phase shifting arrangements in said array;

(b) second memory means, said second memory means being programmed with processing instructions relating to conversion of said beam angle signals into components associated with said antenna coordinate axes;

(c) intermediate command generating means coupled to said first and second memory means, and to said antenna control means, for processing said beam angle signals by means of said processing instructions and said location information for producing unformatted phase shifter control signals representing the phase shifts which each of said phase shifting arrangements must provide to cause said antenna beam to be formed in said direction;

(d) third memory means, said third memory means being programmed with format information relating to the format of said formatted phase control signals required by said phase shifting arrangements of said one of said groups; and (e) formatting means coupled to said third memory means and to said intermediate command generating means, for formatting said unformatted phase shifter control signals for forming said formatted phase control signals;

coupling means coupled to said multipartite phase control means and to said antenna beam control means, for coupling said beam angle signals to said multipartite phase control means by plural paths; and arbitration means coupled to said coupling means and to said multipartite phase control means for arbitrating said beam angle signals to generate arbitrated beam angle signals for use by said multipartite phase control means.

* * * * *